US005535551A

United States Patent [19]

Falk et al.

[11] Patent Number: 5,535,551

[45] Date of Patent: Jul. 16, 1996

[54] ELECTRICAL WINDOW OPERATOR

[75] Inventors: Morten Falk, Copenhagen N; Leon Geisshirt, Solrød Strand, both of Denmark

[73] Assignee: V. Kann Rasmussen Industri A/S, Søborg, Denmark

[21] Appl. No.: 386,481

[22] Filed: Feb. 10, 1995

[51] Int. Cl.[6] ..... E05F 11/00

[52] U.S. Cl. ..... 49/324; 49/140; 49/141

[58] Field of Search ..... 49/324, 141, 139, 49/140

[56] References Cited

U.S. PATENT DOCUMENTS

| | | | |
|---|---|---|---|
| 2,698,173 | 9/1952 | Rydell . | |
| 2,811,349 | 10/1957 | Bondurant et al. | 49/324 |
| 2,899,195 | 8/1959 | Ahlgren | 49/324 |
| 4,068,799 | 1/1978 | Brodin | 49/324 X |
| 4,553,656 | 11/1987 | Lense . | |
| 4,617,758 | 10/1986 | Vetter | 49/324 |
| 4,866,882 | 9/1989 | Cappello | 49/324 |
| 4,929,019 | 5/1990 | Paakkonen et al. | 49/324 |
| 5,097,629 | 3/1992 | Guhl et al. . | |

FOREIGN PATENT DOCUMENTS 0206035 5/1986 European Pat. Off. .

*Primary Examiner*—Philip C. Kannan
*Attorney, Agent, or Firm*—Lane, Aitken & McCann

[57] ABSTRACT

An electrical window operator for opening and closing a window comprises at least one arm connected pivotally and detachably in a first end with a sash coupling member slidable side within a limited part of the length of the sash, said arm being pivotally connected at the other end with a second coupling member connected with the main frame. An operator housing arranged at the main frame accommodates an elongate drive shaft with a threaded section engaged by a nut element forming part of the second coupling member and an electrical drive unit in axial extension of the drive shaft.

8 Claims, 2 Drawing Sheets

ELECTRICAL WINDOW OPERATOR

BACKGROUND OF THE INVENTION

The present invention relates to an operator assembly for opening and closing and, more particularly, to an electrical window operator.

Operators are known for moving a window between closed and open positions, for example, a window having a stationary main frame mounted in a roof of a house or other building, especially a sloped roof, and a sash hinged to the main frame at the top of the sash for pivoting toward and away from the main frame. Such operators are typically mounted on a bottom member of the main frame and connected to a bottom member of the sash for pushing the sash away from the main frame and drawing the sash into engagement with the main frame. When the window operator is actuated to move the window in an opening direction it must overcome a component of the weight of the window, especially when the window is mounted in a roof.

In manually operated window openers which may typically be of the kind in which one or a pair of scissors-connected arms are pivotally connected in one end with the sash and in the other end with a manual drive mechanism arranged at the main frame this problem may typically be overcome by providing counterbalancing spring devices to counteract the weight component of the window and, thereby, reduce the force to be applied to the operator for opening the window. Window operators of this kind are disclosed in U.S. Pat. Nos. 5,097,629 to Guhl et al and 2,698,173 to Rydell.

Another way of solving this weight problem is to employ electrical operation of a window opener by connecting the drive mechanism provided at the main frame with an electrical drive unit such as disclosed in U.S. Pat. No. 4,553,656.

SUMMARY OF THE INVENTION

It is the object of the invention to provide an electrical window operator of a very simple and compact mechanical design with high stability and functional reliability whereby the moving parts of the operator between the sash and the main frame may, in the closed condition of the window, be accommodated in a fairly small housing mounted on the bottom of the main frame.

Since window operators of the kind concerned are typically used for opening the window fairly modestly to a ventilating position in which the sash is only slightly removed from the main frame it is a further object of the invention to arrange an electrical window operator to permit manual opening of the window beyond the ventilation position to enable use of the window opening as an emergency exit.

According to the invention there is provided a window operator for opening and closing a window having a generally rectangular main frame and a generally rectangular sash mounted for pivoting movement relative to the main frame about a pivot axis generally parallel to a pair of opposed sides of said sash, comprising:

at least one arm connected pivotally in a first end with a first coupling member connected with one of said opposed sides of the sash and at the other end with a second coupling member connected with a side of said main frame located opposite said one opposed side of the sash, at least one of said pivotal connections of said one and other ends of said arm with said first and second coupling members, respectively forming a detachable coupling, an operator housing arranged at said side of the main frame and accommodating an elongate rotatable drive shaft with a threaded section of a length said second coupling member comprising a nut element engaging said threaded section of the drive shaft to be longitudinally displaceable within the length thereof by rotation of the drive shaft, and an electrical drive unit comprising a motor and transmission means arranged in said operator housing in axial extension of said drive shaft for rotation of said shaft in one or the other direction of revolution.

BRIEF DESCRIPTION OF THE DRAWINGS

In the following the invention will be further explained with reference to the schematical drawings in which.

DETAILED DESCRIPTION

Figure 1:
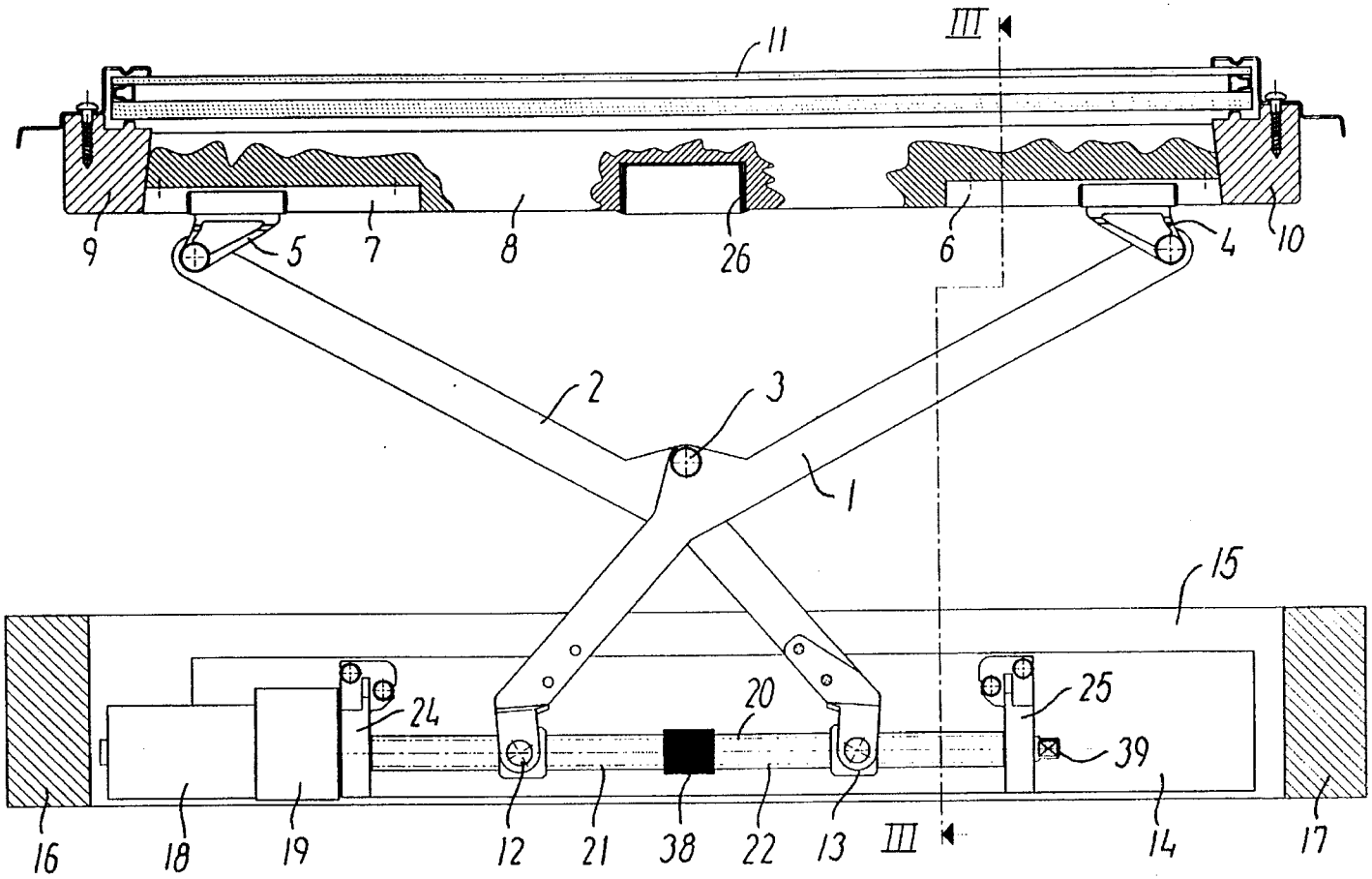
FIGS. 1 and 2 show a preferred embodiment of a window operator according to the invention as viewed from above in open and closed positions, respectively.
Figure 3:
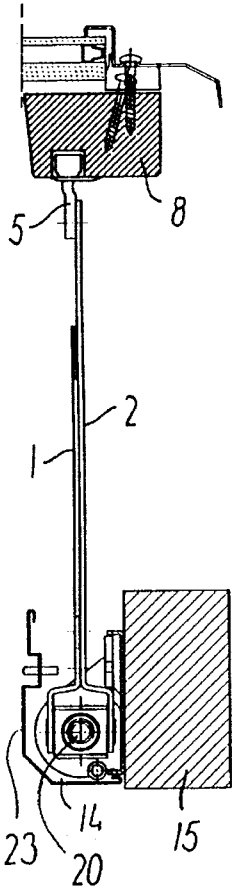
FIG. 3 is a sectional view along the line III—III in FIG. 1.
Figure 2:
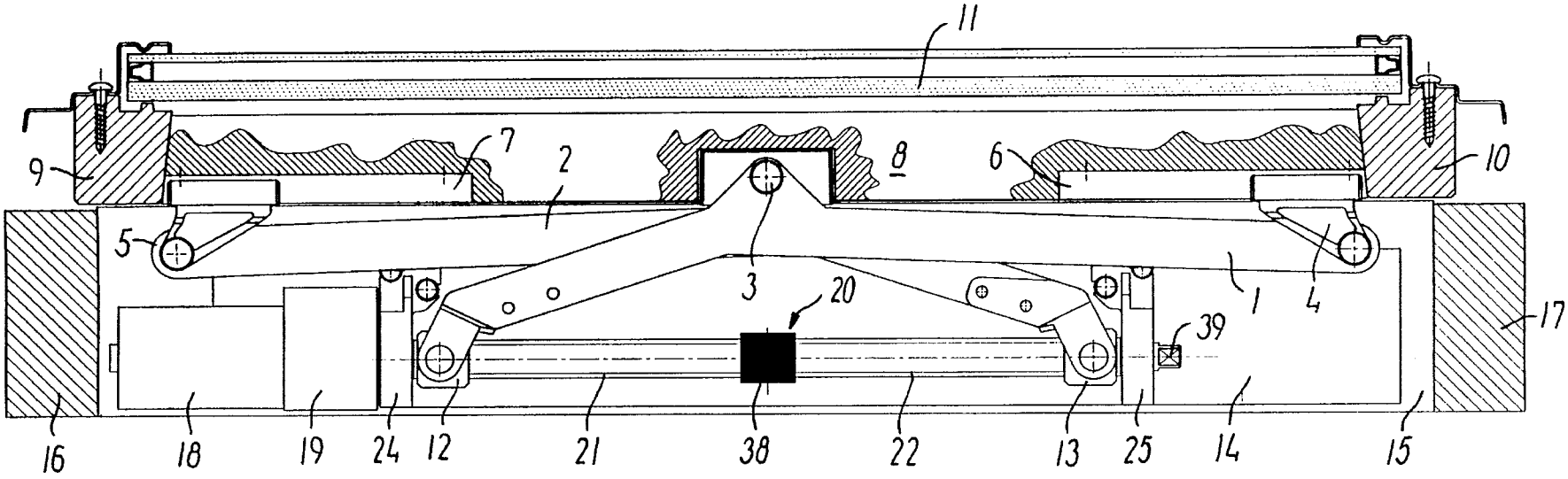

In the preferred embodiment shown in FIGS. 1 to 3 the window operator according to the invention comprises a pair of mirror symmetrical pivoting arms 1 and 2 connected in a scissors-like fashion in a pivotal joint 3. Each of pivoting arms 1 and 2 is pivotally connected at one end with a first sash coupling member 4, 5, respectively, which is slidably arranged in a guide way 6 and 7, respectively, provided in a bottom member 8 of the window sash of which also the vertical side members 9 and 10 as well as the glazing 11 are shown.

In the embodiment shown the sash may be hinged with the main frame of the window at the top in a known—not illustrated—manner.

Figure 5:
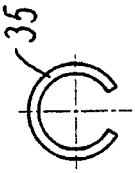
FIG. 5 shows a split-spring locking device for the detachable coupling in FIG. 4.

As further explained below with reference to FIGS. 4 and 5 the pivotal connection of each of arms 1 and 2 with sash coupling members 4 and 5 is arranged to be detachable to permit opening of the sash beyond the ventilation position, e.g. to permit use of the window opening as an emergency exit.

At the opposite end each of arms 1 and 2 is pivotally connected with a second coupling member 12 and 13, respectively, engaging a drive mechanism accommodated in an operator housing 14 secured to the bottom member 15 of the main frame of which also the vertical side members 16 and 17 are shown.

More specifically the drive means of the operator comprises an electrical power unit with a motor 18 and transmission gear 19 operating an elongate drive shaft 20.

The elongate drive shaft 20 comprises two separate threaded sections 21 and 22 with opposite directions of threading and the main frame coupling members 12, 13 comprise nut members in engagement with the threaded sections 21 and 22, respectively.

By this rather simple mechanical arrangement rotation of drive shaft 20 in one direction of revolution will displace main frame coupling members 12 and 13 away from each other, whereby the sash will be moved in the direction of closing via pivoting arms 1 and 2, whereas by rotation of the drive shaft 20 in the opposite direction of revolution the main frame coupling members 12 and 13 will be moved closer to each other to move the sash in the opening direction. In order to take up impact forces in the extreme positions of the coupling members 12 and 13 during the latter movement the two threaded sections 21 and 22 may be separated by an elastic buffer element 38 such as a sleeve of elastomeric material secured to shaft 20.

In FIG. 1 the window is shown in a intermediate position approximately half way towards the full ventilation position obtainable by means of the electrical operator, whereas in FIG. 2 the arrangement is shown in the fully closed position of the sash with respect to the main frame. In this position, the pivoting arms 1 and 2 forming the moving parts of the operator are substantially fully accommodated beneath an upper wall 23 of the operator housing 14 as shown in FIG. 3 so that in the closed position of the window no mechanical part of the operator will be visible.

In order to give room for bearing devices 24 and 25 for the drive shaft 20 in the closed position of the window each of pivoting arms 1 and 2 is of a slightly angled design having its apex at pivotal joint 3 and a cavity 26 is provided in sash bottom member 8 to accommodate the apex parts of arms 1 and 2 in the closed position as shown in FIG. 2.

In consequence of the geometrical arrangement each of the threaded sections 21 and 22 of drive shaft 20 has a length determined by the length of each of guide ways 6 and 7 in the sash bottom member 8.

Figure 4:
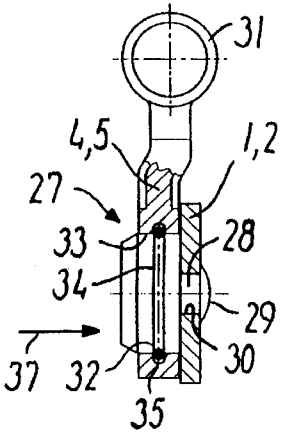
FIG. 4 shows an example of a detachable coupling between a pivoting arm of the window operator and a sash coupling member.

In the embodiment shown, the pivotal joint between each of arms 1 and 2 and sash coupling members 4 and 5 is designed, as illustrated in FIG. 4, as a detachable coupling comprising a pin-like member 27 of which a first part 28 of a relatively small diameter is secured in a hole 30 in the end of the pivot arm said first part having an enlarged head portion 29 engaging one side of the pivot arm 1 or 2.

A second enlarged portion 32 of the pin-like member 27 is inserted in a bore 33 in the sash coupling member 4 or 5 which otherwise comprises a mainly cylindrical guide member 31 permitting the sash bottom member 8 and the pivot arms 1 and 2 to turn with respect to each other during the opening or closing movement. The enlarged section 32 of the pin-like member 27 is retained in the bore in the sash coupling member by resilient locking means which in the embodiment shown comprises a split annular spring member 35 as shown in FIG. 5 arranged in a groove 34 on the enlarged second section 32 of the pin-like member 27.

In order to provide this detachability also in the closed position of the sash with respect to the main frame the upper wall 23 of operator housing 14 may form a detachable screen for easy removal in a situation requiring use of the window opening as an emergency exit. This detachability also provides an advantageous possibility for manual operation in case of power failure with resulting inoperability of the electric motor by providing drive shaft 20 with means e.g. a machined end 39 of the drive shaft engageable by a tool such as a wrench or a screw-driver for manual operation.

The detachability of arms 1 and 2 may also be provided, however, at the pivotal connection of each arm with the second coupling member 12 and 13, respectively By application of a detachment force in the direction of arrow 37 in FIG. 4 the sash coupling member 4 or 5 may be detached from the pivot arm 1 or 2 with the pin-like member 27.

Whereas the invention has been described so far with reference to the preferred embodiment incorporating a pair of scissors-like connected pivoting arms it is within the scope of the following claims to employ one pivoting arm only and a drive shaft with only one threaded section engaged by a coupling member connected with one end of the pivoting arm. By such a design which may be suitable in particular as a fairly inexpensive operator for smaller size window, there is no need for a slidable connection of the first coupling member with the sash side.

Moreover, other designs of detachable locking means may be used to provide the detachable coupling between the sash and the pivot arm or arms.

We claim:

1. A window operator for opening and closing a window having a generally rectangular main frame and a generally rectangular sash mounted for pivoting movement relative to the main frame about a pivot axis generally parallel to a pair of opposed sides of said sash, comprising:

at least one arm connected pivotally in a first end with a first coupling member connected with one of said opposed sides of the sash and at the other end with a second coupling member connected with a side of said main frame located opposite said one opposed side of the sash, at least one of said pivotal connections of said one and other ends of said arm with said first and second coupling members, respectively forming a detachable coupling, an operator housing arranged at one side of the main frame and accommodating an elongate rotatable drive shaft with a threaded section of a predetermined length, said second coupling member comprising a nut element engaging said threaded section of the drive shaft to be longitudinally displaceable within said predetermined length thereof by rotation of the drive shaft, and an electrical drive unit comprising a motor and transmission means arranged in said operator housing in axial extension of said drive shaft for rotation of said shaft in one or the other direction of revolution.

2. A window operator as claimed in claim 1 wherein said detachable coupling is provided between said first end of said arm and said first coupling member and comprises a pin-like member with a first part of a relatively small diameter secured in a hole in said first end of the arm and having an enlarged head portion engaging one side of said first end around said hole, and a second enlarged section inserted in a bore in said first coupling member, resilient locking means being provided to retain said second section in said bore but permitting detachment of said first coupling member by said arm by application of a detachment force on an end of said second section opposed to the enlarged head portion of said first section of the pin like member.

3. A window operator as claimed in claim 2, wherein said resilient locking means comprises an annular split-spring member arranged in a groove on said second section of the pin-like member for engagement with a recess at the wall of said bore in said first coupling member.

4. A window operator as claimed in claim 1, wherein an elastic buffer element is provided at least at one end of said threaded section to take up impact forces of said second coupling member when moving in one direction along said shaft.

5. A window operator as claimed in claim 1, wherein an upper wall part of said operator housing is formed by a detachable screen.

6. A window operator as claimed in claim 5, wherein said drive shaft is provided with means engageable by a tool for manual operation of said shaft.

7. A window operator as claimed in claim 1, comprising a second arm configured and arranged in mirror symmetry with said first arm with respect to a center plane perpendicular to said opposite sides of the sash and main frame, said first and second arms being pivotally connected in a scissors-like fashion in a pivotal joint closer to said second end of any of said arms than to said first end, said first coupling member for each of said arms being connected with said one opposed side of the sash to be slidable in the longitudinal direction thereof within a limited part of the length of said side adjacent one end thereof, said drive shaft comprising two threaded sections each of said predetermined length, said sections being in actual extension of each other and with oppositely directed threading, said predetermined length corresponding to the length of said limited part within which each of said arms is slidable with respect to the sash, the first and second ends of said second arm being coupled with coupling members similar to said first and second coupling members, respectively, the second coupling members for said first and second arms engaging one and the other of said threaded sections of said drive shaft.

8. A window operator as claimed in claim 7, wherein said threaded sections are separated by an elastic buffer element to take up impact forces of said second coupling members pivotally connected with said first and second arms, respectively.

* * * * *